US009767645B1

(12) United States Patent
Cronin et al.

(10) Patent No.: US 9,767,645 B1
(45) Date of Patent: Sep. 19, 2017

(54) INTERACTIVE GAMING AT A VENUE

(71) Applicant: ProSports Technologies, LLC, Miami, FL (US)

(72) Inventors: John Cronin, Bonita Springs, FL (US); Nick Reasner, Miami, FL (US)

(73) Assignee: PROSPORTS TECHNOLOGIES, LLC, Miami, FL (US)

( * ) Notice: Subject to any disclaimer, the term of this patent is extended or adjusted under 35 U.S.C. 154(b) by 0 days.

(21) Appl. No.: 14/798,333

(22) Filed: Jul. 13, 2015

Related U.S. Application Data

(60) Provisional application No. 62/023,811, filed on Jul. 11, 2014.

(51) Int. Cl.
*G07F 17/32* (2006.01)

(52) U.S. Cl.
CPC ..... *G07F 17/3241* (2013.01); *G07F 17/3288* (2013.01)

(58) Field of Classification Search
CPC ..... G07F 17/3288; G07F 17/3202; G07F 17/3204; G07F 17/3225; G07F 17/3241
USPC ..... 463/25, 29, 40
See application file for complete search history.

(56) References Cited

U.S. PATENT DOCUMENTS 8,216,072 B2 7/2012 Curtis et al.
8,414,393 B2 * 4/2013 Tarama ..... 3/53
8,423,622 B2 * 4/2013 Jhanji ..... G06Q 30/0259 709/203
8,510,247 B1 * 8/2013 Kane, Jr. ..... G06N 5/02 706/46
8,632,392 B2 * 1/2014 Shore ..... 463/25
9,137,086 B1 * 9/2015 Naik ..... H04L 29/0602
9,195,982 B2 * 11/2015 Orr ..... G06Q 20/204
9,201,885 B1 * 12/2015 Nasserbakht ..... G06F 15/7807
2002/0160823 A1 * 10/2002 Watabe ..... A63F 13/10 463/7
2007/0179792 A1 * 8/2007 Kramer ..... G06Q 30/02 705/1.1
2007/0197247 A1 8/2007 Inselberg
(Continued)

FOREIGN PATENT DOCUMENTS

KR 10 2013 00298 3/2013

OTHER PUBLICATIONS

"GTECH to aquire sports-betting solutions provider finsoft limited", GTECH News & Financial, May 15, 2007.
(Continued)

*Primary Examiner* — Michael Cuff
(74) *Attorney, Agent, or Firm* — Polsinelli LLP

(57) ABSTRACT

The present disclosure concerns a mobile application that allows for interactions with an interactive gaming processor hosted by a venue. The venue hosts various sporting events. The interactive gaming processor—in conjunction with the mobile application on a user mobile device—allows an event attendee to bet or engage in gameplay challenges by way of their mobile device and that concern real-world undertakings or interactions taking place on the field of play at the venue. Users may engage other friends present at the same venue and viewing the same event or engage those in seats near the user. Winning bets or gameplay interactions may result in credits that translate to real-world dollars, coupons for various food, drink, or souvenir offerings, or tickets to future events.

15 Claims, 4 Drawing Sheets

(56) References Cited

U.S. PATENT DOCUMENTS

2007/0288969 A1 12/2007 Prum
2008/0076505 A1* 3/2008 Nguyen ..... G07F 17/32 463/16
2008/0102956 A1* 5/2008 Burman ..... G06Q 20/3224 463/42
2010/0080163 A1* 4/2010 Krishnamoorthi .... H04L 12/189 370/312
2011/0238755 A1* 9/2011 Khan ..... G06Q 50/01 709/204
2011/0282972 A1* 11/2011 Rosen ..... G06Q 30/02 709/219
2012/0028718 A1* 2/2012 Barclay ..... G07F 17/3218 463/42
2012/0121128 A1* 5/2012 Lawrence ..... A63F 13/06 382/103
2012/0142428 A1 6/2012 Wilson et al.
2012/0215637 A1 8/2012 Hermann
2013/0060623 A1* 3/2013 Walker ..... G06Q 30/0259 705/14.27
2014/0024435 A1* 1/2014 Scott ..... G07F 17/3223 463/25
2014/0027980 A1 1/2014 Renier
2014/0171039 A1* 6/2014 Bjontegard ..... H04L 29/06034 455/414.1
2014/0237076 A1* 8/2014 Goldman ..... G06F 17/3087 709/217
2014/0239733 A1* 8/2014 Mach ..... H02J 5/005 307/104
2014/0280005 A1* 9/2014 Powers ..... G06F 17/30864 707/706
2015/0005060 A1* 1/2015 Shankar ..... G07F 17/329 463/26
2015/0050988 A1* 2/2015 Nichols ..... H04L 63/107 463/25
2015/0127445 A1* 5/2015 Jaffee ..... G06Q 30/0224 705/14.25
2015/0189490 A1* 7/2015 Chan ..... H04W 8/02 455/419
2015/0381760 A1* 12/2015 Mate ..... H04N 21/4788 709/205
2016/0006264 A1* 1/2016 Alperin ..... H02J 5/005 307/104

OTHER PUBLICATIONS

Milner et al., Annette; "Mobile Sports Betting—A future perspective", IT-University, Jun. 2002.
"XSS-EPOS—No-Risk Self-Service Sports Betting Kiosk", BetXTech, May 30, 2014, //www.betxtech.co.im/en/solutions/xss-epos-no-risk-self-service-sports-betting-kiosk_4a0d6778446e2.html.
U.S. Appl. No. 14/839,007 Office Action dated Feb. 19, 2016.
U.S. Appl. No. 14/839,007 Final Office Action dated Aug. 26, 2016.

* cited by examiner

INTERACTIVE GAMING AT A VENUE

CROSS-REFERENCE TO RELATED APPLICATIONS

The present application claims the priority benefit of U.S. provisional application 62/023,811 filed Jul. 11, 2014 and entitled "Interactive Gaming at Sporting Events," the disclosure of which is incorporated herein by reference.

BACKGROUND OF THE INVENTION

Field of the Invention

The present invention generally relates to rewarding engagement with a sports franchise. The present invention more specifically relates to utilizing social and gaming platforms to engage with a sports franchise in real time at a venue hosting an event involving said franchise.

Description of the Related Art

Sporting events involve a significant amount of downtime. For example, an NFL football game is technically a 60-minute affair with four 15-minute quarters, the duration of the game is usually closer to three or four hours. The reasons for the discrepancy in game-play time versus actual time is nearly endless. For example, the imposition of injury time outs, TV time outs, team time outs, and half-time alone add considerable time to the course of the game. Resetting the ball in the field of play, instant replay of disputed calls, and interrupting on field skirmishes also lend to the actual length of the event.

During this time, attendees at a football game or other sporting event may become bored or distracted. Many attendees will now turn to their mobile device to "surf the web" or check in on any number of social media platforms. While various venues will attempt to entertain attendees with highlights on the Jumbo-Tron or other events on the field of play, they cannot compete with the variety of content otherwise available to a user on their mobile.

There is a need in the art for sports teams and venue operators to better engage fans during downtimes in game play by way of user mobile devices.

SUMMARY OF THE CLAIMED INVENTION

In a first claimed embodiment of the present invention, a system for interactive gaming at a venue is recited. The system includes a mobile device executing a gaming application. The system further includes an interactive gaming processor. The interactive gaming processor includes an account module stored in memory and executable by a processor to access an account database, a gaming module stored in memory and executable by a processor to access a gaming database, and a rewards module stored in memory and executable by a processor to access a rewards database. The interactive gaming processor allows a user of the mobile device to engage in interactive game play with respect to a sporting event at the venue during event downtime.

A method for interactive gameplay at a venue is set forth in a second claimed embodiment of the present invention. The method includes receiving login information from a user mobile device and verifying login information from the user mobile device with respect to whether the user is eligible to take part in interactive gameplay at the venue. The method also includes receiving geo-location information from the user mobile device and verifying the geo-location information from the user mobile device with respect to whether the user is eligible to take part in interactive gameplay at the venue. The user is then presented a prompt for interactive gameplay related to an event taking place at the venue. The processor receives a response to the prompt and renders a reward based on the response to the prompt.

A third claimed embodiment of the present invention includes a further method for interactive gameplay at a venue. The method includes receiving login information from a user mobile device and verifying login information from the user mobile device with respect to whether the user is eligible to take part in interactive gameplay at the venue. The method also includes receiving geo-location information from the user mobile device and verifying the geo-location information from the user mobile device with respect to whether the user is eligible to take part in interactive gameplay at the venue. The processor also receives information related to a social media platform and a user on the social media platform. The processor then brokers a bet between the user of the mobile device and the user on the social media platform. The processor renders a reward based on the bet between the user of the mobile device and the user on the social media platform.

DETAILED DESCRIPTION

Embodiments of the present invention allow a user to introduce a mobile application to a mobile device. The mobile applications allows for interactions with an interactive gaming processor hosted by a venue that, in turns, hosts various sporting events. The interactive gaming processor—in conjunction with the mobile application on the user mobile device—allows an event attendee to bet or engage in gameplay challenges by way of their mobile device and that concern real-world undertakings or interactions taking place on the field of play at the venue. Users may engage other friends present at the same venue and viewing the same event or engage those in seats near the user. Winning bets or gameplay interactions may result in credits that translate to real-world dollars, coupons for various food, drink, or souvenir offerings, or tickets to future events.

Figure 1:
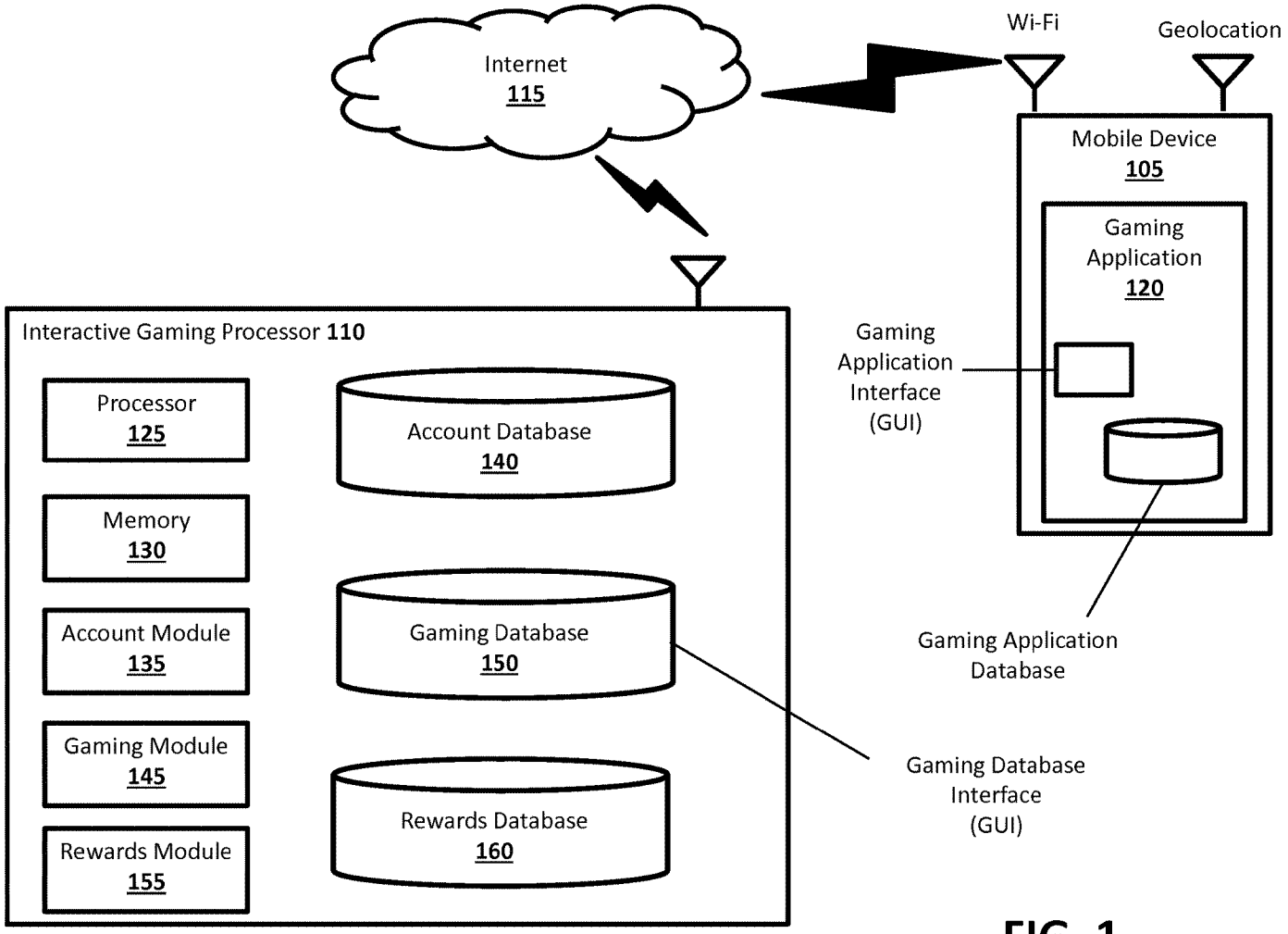
FIG. 1 illustrates a system for interactive gaming at a venue.

FIG. 1 illustrates a system 100 for interactive gaming at a venue. Shown in FIG. 1 as a part of system 100 are a mobile device 105 and interactive gaming processor 110. Mobile device 105 and interactive gaming processor 110 are communicatively coupled with way of Internet 115.

Mobile device 105 is inclusive of smartphones such as iPhones and Android devices. Mobile device 105 is similarly inclusive of tablets, phablets, and wearable devices. In some instances, a venue or event specific hardware device distributed to attendees as a part of the event can substitute for the functionality of mobile device 105. Event or venue specific hardware devices might be distributed to users upon registration at or entry into an event at a venue. Such devices could also be built into or installed as a part of a particular seating area. For example, a hardware device might be built into the back of a seat at a stadium or made available as a POS or other terminal type device.

Mobile device 105 includes geo-location functionality. Geo-location allows for the identification of the real-world geographic location of mobile device 105. Geo-location can be performed by associating a geographic location with the Internet Protocol (IP) address of the mobile device 105 and a presently accessed network, MAC address of the mobile device 105 with respect to a presently accessed network, radio frequency identification (RFID), wireless positioning systems, device fingerprints, device global positioning system (GPS) coordinates, or self-disclosed information.

Installed on mobile device 105 is gaming application 120. This application may be downloaded from the likes of an "application store" such as the Apple AppStore or Google's Google Play store. Applications might also be installed by way of a provisioning system that operates in conjunction with the wireless network of a particular venue. For example, in order to access venue wireless services, the user may be required to allow the wireless system to provision and install gaming application 120. The application 120 may likewise be pre-installed in the context of an event specific hardware device, especially where the device is physically embedded in venue seating or a part of a POS or terminal device made available to users and attendees.

Mobile device 105 stores gaming application 120 in a non-transitory computer readable storage medium. Said application 120 is executed and offers its specific functionality by way of one or more processing devices present on mobile device 105. Data hosted or generated by mobile device 105 and that might otherwise be requested from interactive gaming processor 110 (as well as that information hosted, generated, or accessible by interactive gaming processor 110 and requested by mobile device 105) is exchanged by way of Internet 115 or some other communications network.

As known to one of ordinary skill in the art, the Internet 115 is a global system of interconnected computer networks that use the standard Internet protocol suite (TCP/IP) to link several billion devices worldwide. Internet 115 might be supported by any number of wireless, wired, or cellular (e.g., 3G, 4G, LTE) networks as well as various backbone architecture components not otherwise discussed in detail here. Nor are various software and hardware components at mobile device 105 that allow for access to Internet 115 in that such components are known to one of ordinary skill in the art.

Returning to mobile device 105 as illustrated in FIG. 1, application 120 executes to generate an interactive user interface accessible to user on a display of mobile device 105. Application 120 also executes to partition or allocate a portion of storage at the mobile device 120 for gaming application 120 data. Interface of application 120 is discussed in greater detail with respect to FIG. 3.

Interactive gaming platform 110 may be a suite of services and functionalities integrated into a single computing platform and hosted on a single server or may be distributed both in terms of software and hardware operation. Interactive gaming processor 110 includes an antenna and corresponding communications componentry. Reference to (and illustration of) antenna in FIG. 1 is exemplary and meant to be representative of any network interface device that allows for access to Internet 115. Communications componentry is inclusive of the requisite hardware and/or software components to allow for network access by way of antenna or similarly operable network interface.

Interactive gaming processor 110 includes standard computing hardware such as a processor 125 and memory 130 in order to implement the various functionalities discussed herein. For example, various software modules or instructions may be installed in memory 130 or other non-transitory computer readable media communicatively coupled to the interactive gaming processor 110. Said modules or instructions may then be executed from memory 130 by processor 125.

Account module 135 is executable from memory 130 by processor 125 to track account access to interactive gaming processor 110 by a particular gaming application 120 executing on mobile device 105. Various information concerning application 120, login information, user information, and other user account details may be maintained in account database 140, which is otherwise accessible to account module 135. This information includes, but is not limited to, user credits or amount of monies available for expenditure as use in system 100.

Gaming module 145 is executable from memory 130 by processor 125 to allow for various interactive gaming activities at a particular venue by a particular gaming application 120 executing on mobile device 105. Types of gameplay available by way of gaming module 145 may depend on location of the mobile device 105 as might be determined by geo-location functionality of the mobile device 105. For example, the mobile device 105 (and its corresponding user) may need to be present at the venue or located in a particular portion of the venue to engage in certain types of gameplay. Certain gameplay features may also be available to certain users as might be determined by account module 135 and account database 140. For example, a user may need to have a certain number of credits available or a verified account to engage in certain forms of gameplay.

Gaming database 150 may host information necessary to engage in gameplay of a certain form. For example, database 150 may include instructions related to rendering an interface at the GUI of gaming application 120 and mobile device 105. Database 150 may also contain rules related to initiating and carrying out gameplay (i.e., the rules of the particular game being executed by gaming module 145 by way of processor 125). Database 150 may also include information concerning soliciting and transacting various bets or other interactions related to gameplay. For example, database 150 might include information about when a bet may be received, how much may be bet, and the outcome of the bet based on various real-world outcomes concurrently taking place at the venue, Database 150 may also include rules concerning who might engage in gameplay.

Figure 2:
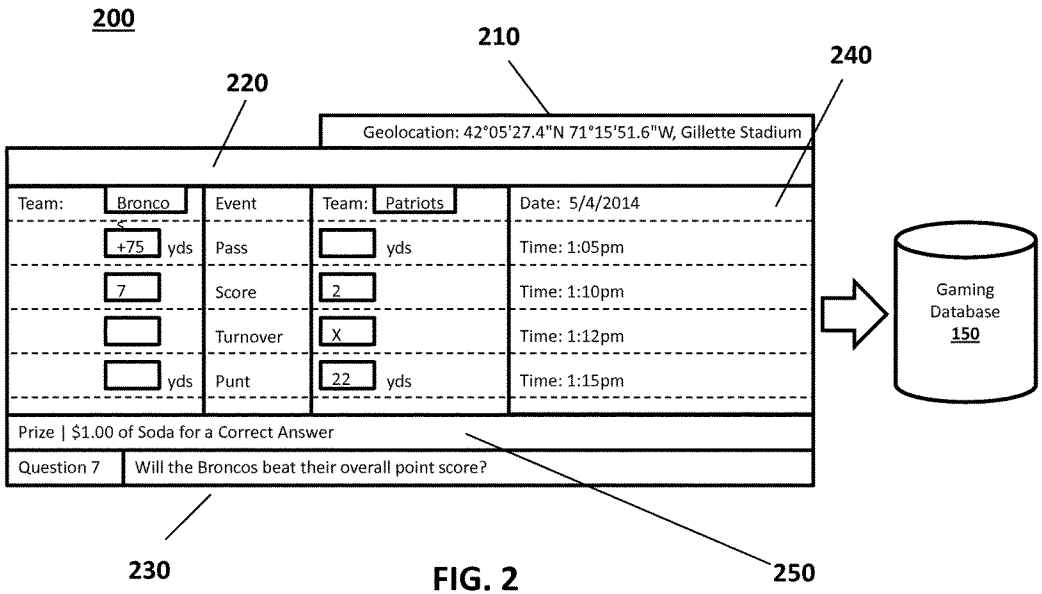
FIG. 2 illustrates an interface for introducing information into gaming database at interactive gaming processor.

Gaming database 150 is communicatively coupled to gaming database interface, which is described in greater detail with respect to FIG. 2. Gaming database 150 may also include queries to made of a user during the course of an event. Such queries may be displayed on interface of gaming application 120. Gaming database 150 may also maintain statistics that will reflect answers to such queries (e.g., how many yards have been accumulated by a particular team during the course of the game).

Rewards module 155 generates rewards for successful gameplay instantiated by gaming module 145 and gaming database 150. Rewards may be a collection of rewards maintained by rewards database 160 such as tickets to future events at the venue, upgrades to better seats within the venue, special meet-and-greet events with a sports team that plays at the venue, or coupons for food, drink, and souvenirs at the venue. Rewards might also include a simple granting of credits based on a particular bet during gameplay (e.g., 2-to-1 odds, 5-to-1 odds, and so forth).

FIG. 2 illustrates an interface 200 for introducing information into gaming database 150 at interactive gaming processor 110. Interface 200 may be manually populated with data from an individual watching a particular sporting event. Interface 200 may also be tied into a statistical maintenance application that automatically tracks statistics for formal league record keeping, for reporting to fantasy gaming applications, or to report to teams for statistical analysis and record keeping. Such an application may plug-in to interface 200 to populate the same. Interface 200 may similarly pull such statistics from a database maintaining the same.

Interface 200 as illustrated in FIG. 2 includes geo-location information of the venue or event. The geo-location information of the venue (210) may be used to verify whether a particular mobile device 105 and its corresponding gaming application 120 are actually at the event or the venue hosting the same. Geo-location information might also be associated with particular sections of a given venue. A determination might be made from GPS information or a mobile device 105 accessing a particular wireless access point or cellular base station within the venue.

As gameplay unfolds, interface 200 is populated with game play data 220 such as passing yards, score, turn overs, and punting yards. Other game play statistics may be provided subject to the particular game or sporting event taking place at the venue. For example, baseball will have one set of statistics populating game play data 220 whereas football will have a separate set of statistics.

Interface 200 also allows for the entry of specific gameplay questions 230 that may be delivered to users during the course of game play by way of gaming application 120. Interface 200 also tracks date and time of a last statistical entry in field 240 to ensure that answers provided responsive to a query (230) are temporally correct. For example, an answer might be provided by way of gaming application 120 at one point in the game that is—at that time—correct. Statistics might later accumulate that cause that answer to now be in error. Time and date field 240 ensures that answers are accurate as of the time of entry by a user at gaming application 120 and its corresponding GUI.

Interface 200 also allows for entry of a potential prize (250) for a user providing a correct answer. The nature of the prize entered into interface 200 at field 250 may likewise be transmitted to the user at the GUI at their gaming application 120. In some instances, however, the particular question will allow for 'bets' amongst attendees as is discussed in further detail in the context of FIG. 3.

Figure 3:
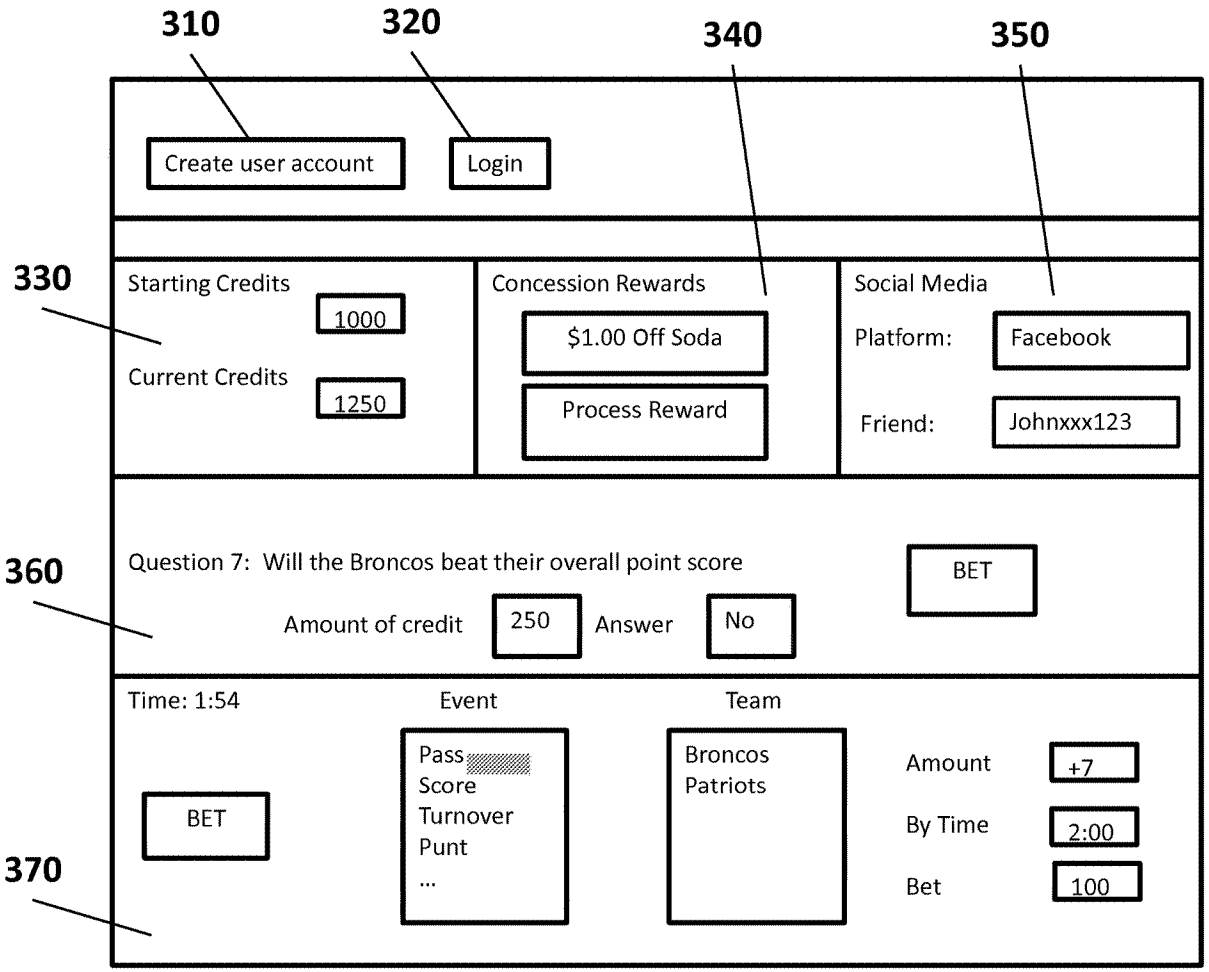
FIG. 3 illustrates an exemplar GUI as might be found at the gaming application of a mobile device.

FIG. 3 illustrates an exemplar GUI 300 as might be found at the gaming application 120 of a mobile device 105. Through the interface 300, a user may create an account (310) or log-in (320) to a pre-existing account. Account creation and login activities may occur in conjunction with account module 135 and account database 140. Credits field (330) illustrates both a starting credit allotment and a current credit allotment such that a user may comprehend whether they are "ahead" or "behind" in a current engagement. Maintenance and tracking of credits may take place in conjunction with the aforementioned account module 135 and account database 140 and, in some instances, rewards module 155 and rewards database 160 where a particular reward happens to be additional system credits.

With respect to rewards module 155 and rewards database 160, FIG. 3 also illustrates rewards field 340, which indicates various rewards that a user has previously been granted due to a successful interaction with the interactive gaming processor 110 of the present invention. The user may, through an interaction with rewards field 340, redeem or otherwise utilize a particular reward. In the example illustrated in FIG. 3, a user currently is in possession of a $1.00 concession coupon. The user is likewise presented with the opportunity to redeem the same. Other rewards—including gameplay credits—can be displayed and redeemed through this portion of an exemplary interface.

Interface 300 also includes social media integration field 350. Through the use of a social media plug-in or integration function, a user can engage in various bets or gameplay interactions with friends or connections in any one of a variety of social networks. Examples of social networks that might be integrated into interface 300 and system 100 include Facebook, LinkedIn, Twitter, Pintrest, Google+, Tumblr, Instagram, or Vine.

Use of social media integration field 350 may require the user to provide one or more pieces of information such that social media integration field 350 and gaming application 120 can make a proper query of a corresponding social network. This information might include identifying social networks to which the user is a member, user names and/or login credentials, permission to access information, permission to distribute information, and permission to retain information. The user may likewise be required to provide an affirmation of allowing for informational access directly to the social network before application 120 may access any given network.

Once a user has provided application 120 with the necessary permissions to access a social network by way of social media integration field 350, the user can challenge friends to bets or other challenges. As shown in FIG. 3, the operator of interface 300 has challenged friend "Johnxxx123" to engage in a bet on a current question rendered by interactive gaming processor 110. In some instances, social media integration field 350 may instead allow a user to challenge users in particular seats of the venue to similar bets or gameplay challenges. The use of social media integration 350 is discussed in further detail below with respect to non-system prompted betting field 370.

Interface 300 of FIG. 3 also includes betting field 360. System prompted betting field 360 presents a question subject to the gameplay bet, as well as the option to set a bet (250 credits), and the answer to the query (no). A "BET" soft key is also provided to allow for confirmation of the bet and entry of the same into the interactive gaming processor 110. System prompted betting field 360 concerns questions prompted by the interactive gaming processor 110 and not bets or challenges from other users of the system 100.

For such one-on-one bets, a user would utilize non-system prompted betting field 370. Such bets would be made in conjunction with social media integration function 350. As shown in field 370, a user is given the nature of a betting event that corresponds to an event taking place during game play, the team that the user believes will achieve that event, as well as other data including the amount by which a team might achieve a certain result, the timing of that result, and the amount being bet as a part of the event proposition. A "BET" soft key is also provided to allow for confirmation of the bet and entry of the same into the interactive gaming processor 110.

Figure 4:
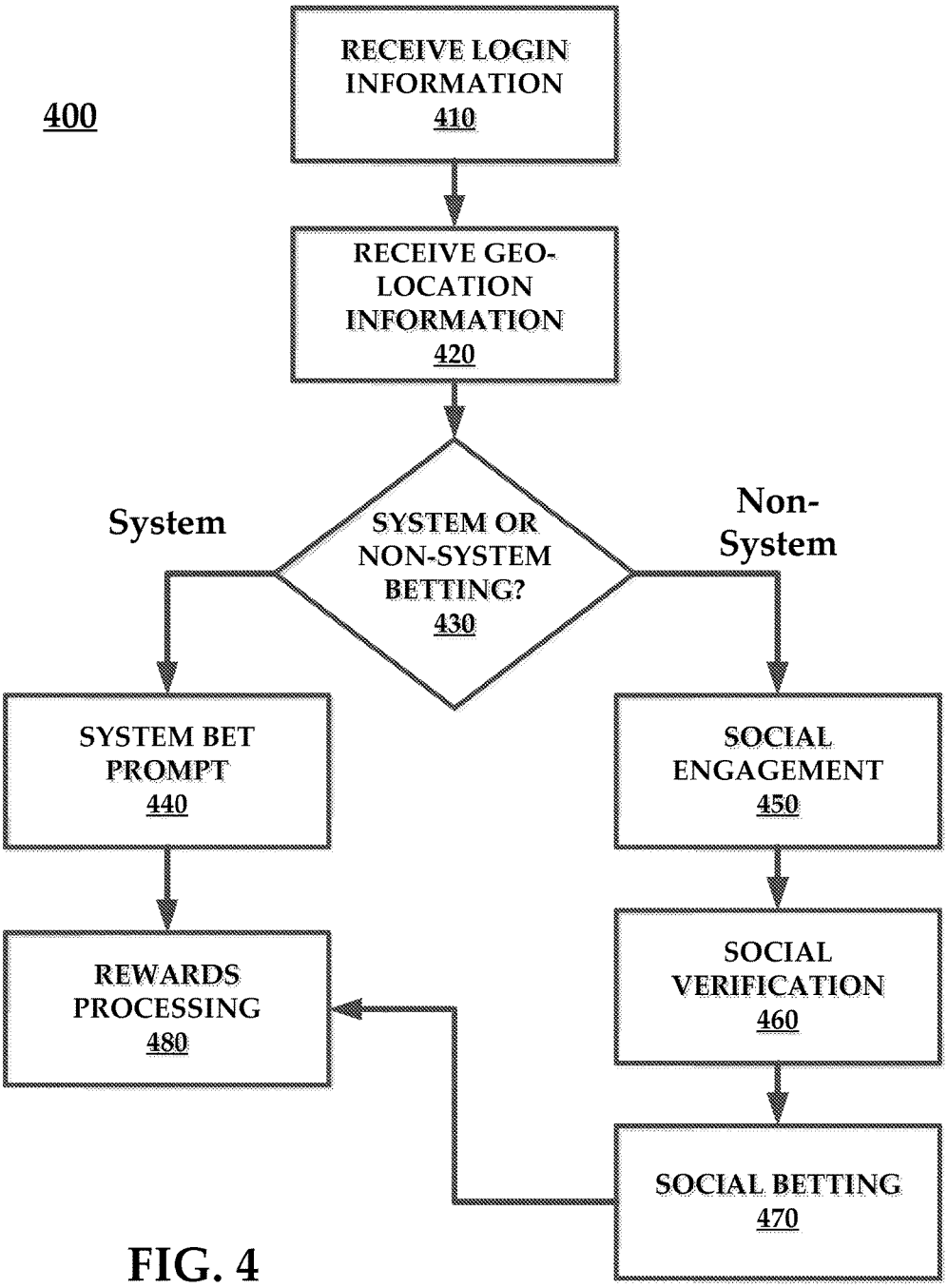
FIG. 4 illustrates a method for use of the interactive gaming processor of the present invention.

FIG. 4 illustrates a method 400 for use of the interactive gaming processor 110 of the present invention. At step 410 of method 400, the gaming processor 110 receives a login request. Login operations are managed by execution of account module 135, which retrieves various data from account database 140 to verify the presentation of proper login credentials. In the event that a user presents an improper user ID and/or password combination, the account module 135 may prompt a user to re-present the same. If it is determined that a user does not have an account (i.e., the user proactively identifies the need to create an account), then the account module 135 may execute to create the same and store related information in account database 140.

At step 420, a geo-location verification operation takes place to ensure that the user is authorized to take part in various gameplay operations offered by a particular interactive gaming processor 110. Gaming processor 110 may serve a particular venue or may be a scaled system that serves multiple venues. The gaming application 120 executing on mobile device 105 may allow for interactions at any number of venues by way of said processor 110. Geo-location verification will ensure that a user is engaged in game play at the appropriate venue or, in some instances, the appropriate section of the same in order to avoid users having an unfair advantage against other players (e.g., a player present at the venue making bets in real-time with a social connection that is watching the same game on a 10-second broadcast delay).

At step 430 a user is presented the option to engage in system-prompted game play by way of system-prompted betting field 360 or non-system prompted betting by way of non-system-prompted field 370. If a user elects system-prompted betting (i.e., solo game play), then a query is presented at step 440 as might be generated through an interface like that described with respect to element 230 of FIG. 2. The user can then provide responses and bets by way of system-prompted betting field 360 as described with respect to FIG. 3. Betting may include wagering or allocating a certain number of user credits.

If a user elects non-system prompted betting (i.e., one-on-one social game play) at step 430, then a user provides access to a social media account via interface element 350 at step 450. This access includes a platform and a user with whom the player wishes to engage. Prior to engaging in social gameplay, however, the processor 110 will undertake certain verification operations (step 460) of the invited social connection to ensure that the invited player is eligible to take part in gameplay. Invitee verification step 460 may involve certain login and geo-location determinations described above. If an invited user is eligible for interactive gameplay, then the inviting user may prompt the invitee to engage on one or more bets with non-system-prompted field 370 at step 470. At step 480, rewards (or losses) are allocated to the user based on answers to a system-prompted query or the outcome of a social bet. Management of rewards is handled by execution of rewards module 155 and rewards database 160. The actual gaming queries and one-on-one interactions are managed by gaming module 145 and gaming database 150, which is coupled to the aforementioned interface 200 of FIG. 2.

In some embodiments of the present invention, it may be possible for a player to engage in both system-prompted and one-on-one social bets at the same time. For example, and as shown in FIG. 3, a user has been concurrently presented with interface fields 360 and 370. In those embodiments where only a single option is presented or elected, one of the aforementioned fields may be eliminated. FIG. 3 nevertheless remains exemplary with respect to the game play GUI.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

The invention claimed is:

1. A system for interactive gaming at a venue, the system comprising:

a mobile device executing a gaming application during a downtime portion of an event, wherein the mobile device identifies a current location of the mobile device; and an interactive gaming processor, the interactive gaming processor including:

an account database stored in memory and accessible by a processor to retrieve user account information, a gaming database interface stored in memory and executable by a processor to:

verify that the current location of the mobile device seeking to engage in gameplay of the gaming application corresponds to at least one location of one or more predefined sections within a venue, wherein gameplay of the gaming application is allowed only within the predefined sections, authorize the mobile device to engage in gameplay of the gaming application based on verifying that the current location of the mobile device is within the one or more predefined sections of the venue where gameplay of the gaming application is allowed, and carry out one or more transactions related to game play of the gaming application by the mobile device based on proximity of the verified current location of the mobile device to a current location of another user device, wherein the one or more transactions involve real-time statistics regarding the event, and a rewards database stored in memory and executable by a processor to generate rewards based on successful game play.

2. The system of claim 1, wherein the account database is used to effectuate user login.

3. The system of claim 1, wherein the account database is used to manage user credits.

4. The system of claim 1, wherein the account module accesses the account database to determine user eligibility to take part in interactive game play.

5. The system of claim 1, wherein the gaming database is used to manage the rules of interactive game play.

6. The system of claim 1, wherein the gaming database is used to retrieve certain statistics related to interactive game play.

7. The system of claim 6, wherein the gaming database is further coupled to an interface to receive statistics related to interactive gameplay.

8. The system of claim 6, wherein the gaming database is further coupled to an interface to receive queries related to interactive gameplay.

9. The system of claim 1, wherein the rewards database is used to determine a reward for successful interactive gameplay.

10. The system of claim 1, wherein interactive game play with respect to a sporting event at the venue during event downtime includes use of a social media platform.

11. The system if claim 10, wherein the interactive gameplay takes place in conjunction with a member of the social media platform and otherwise associated with the user of the mobile device.

12. The system of claim 1, wherein carrying out the one or more transactions include authorizing transactions with another user.

13. The system of claim 1, wherein the current location of the mobile device is verified as being at the venue of the event, and wherein carrying out the one or more transactions include disallowing gameplay with another user that is not at the venue of the event.

14. A method for interactive gameplay at a venue, the method comprising:

receiving login information from a user mobile device;

verifying login information from the user mobile device;

receiving geo-location information from the user mobile device, wherein the mobile device identifies a current location of the user mobile device;

verifying that the current location of the mobile device seeking to engage in gameplay of the gaming application corresponds to at least one location of one or more predefined sections within a venue, wherein gameplay of the gaming application is allowed only within the predefined sections;

authorizing the mobile device to engage in gameplay of the gaming application based on verifying that the current location of the mobile device is within the one or more predefined sections of the venue where gameplay of the gaming application is allowed;

presenting a prompt for interactive gameplay related to an event taking place at the venue based on the current location of the mobile device being verified as being at the venue and proximity to a current location of another user device, wherein the prompt involves real-time statistics regarding the event;

receiving a response to the prompt; and rendering a reward based on the response to the prompt.

15. A method for interactive gameplay at a venue, the method comprising:

receiving login information from a user mobile device;

verifying login information from the user mobile device;

receiving geo-location information from the user mobile device, wherein the mobile device identifies a current location of the user mobile device;

verifying that the current location of the mobile device engaging in gameplay of the gaming application corresponds to at least one location of one or more predefined sections within a venue, wherein gameplay of the gaming application is allowed only within the predefined sections;

authorize the mobile device to engage in gameplay of the gaming application based on verifying that the current location of the mobile device is within the one or more predefined sections of the venue where gameplay of the gaming application is allowed;

receiving information related to a social media platform including information related to a user on the social media platform;

brokering a bet between the user of the mobile device and the user on the social media platform based on the current location of the mobile device being verified as being at the venue and proximity to a current location of another user device, wherein the bet involves real-time statistics regarding the event; and rendering a reward based on the bet between the user of the mobile device and the user on the social media platform.

* * * * *